US006019569A

United States Patent [19]

Sakuma

[11] Patent Number: 6,019,569

[45] Date of Patent: Feb. 1, 2000

[54] EXCAVATION MACHINE

[75] Inventor: Nobumitsu Sakuma, Chiyoda-machi, Japan

[73] Assignee: Hitachi Construction Machinery Co., Ltd., Tokyo, Japan

[21] Appl. No.: 08/930,242

[22] PCT Filed: Dec. 19, 1996

[86] PCT No.: PCT/JP96/03709

§ 371 Date: Sep. 30, 1997

§ 102(e) Date: Sep. 30, 1997

[87] PCT Pub. No.: WO97/28315

PCT Pub. Date: Aug. 7, 1997

[30] Foreign Application Priority Data

Jan. 31, 1996 [JP] Japan ..... 8-035744
Jan. 31, 1996 [JP] Japan ..... 8-035745
Jan. 31, 1996 [JP] Japan ..... 8-035746

[51] Int. Cl.[7] ..... E02F 3/00

[52] U.S. Cl. ..... 414/695; 414/722; 414/719; 212/347; 212/261

[58] Field of Search ..... 414/687, 688, 414/694, 695.5, 685, 680, 722, 719; 212/347, 261, 238

[56] References Cited

U.S. PATENT DOCUMENTS 4,439,089 3/1984 Anderson et al. ..... 212/347 X
4,728,251 3/1988 Takashima et al. ..... 414/694
5,240,366 8/1993 Bamford ..... 212/261 X

FOREIGN PATENT DOCUMENTS 7-11664 1/1995 Japan .

*Primary Examiner*—Donald W. Underwood
*Attorney, Agent, or Firm*—Oblon, Spivak, McClelland, Maier & Neustadt, P.C.

[57] ABSTRACT

A swing type front working mechanism 7 is provided, the front working mechanism 7 having a foot portion of a lower boom 8L of a boom 8 pivotally supported on brackets 12*a* through a pin 18. A cross-link 40 is connected between the bracket 12*a* and an upper boom 8U by pins 41 and 42 only along the right lateral side of the boom 8, and no cross-link is provided on the side of an operator's cab 6. In the case of a singular cross-link arrangement of this sort, the boom 8 could be operated under biased load distribution, and therefore the lower boom 8L is likely to be subjected to greater stresses or greater lateral bending stresses on the side of the cross-link 40. A boom operating hydraulic cylinder 43 is located in a position which is shifted aside from a center axis A1 of the lower boom 8L in a direction away from the operator's cab 6, thereby forming a lateral load buffer as a counter measure which suppresses or buffers lateral bending stresses of the sort as mentioned above.

7 Claims, 11 Drawing Sheets

EXCAVATION MACHINE

FIELD OF THE ART

This invention relates generally to excavation machines like hydraulic power shovels to be used for ground excavation, and more particularly to an ultra-mini turn type excavation machine having a boom comprised of two parts which are foldable into and out of an angularly bent form through a cross-link, permitting to make turns within an extremely small radius.

TECHNICAL BACKGROUND

Excavation machines, for example, hydraulic power shovels are largely constituted by a base carrier and an upper rotary body which is rotatably mounted on the base carrier through a swivel mechanism. Provided on the upper rotary body are an operator's cab to be occupied by a machine operator, and a front working mechanism including a boom, an arm and a bucket. The boom, arm and bucket are driven from hydraulic cylinders, and, for driving these hydraulic cylinders and other hydraulic actuators such as vehicle drive motor and rotating motor, an engine is accommodated on a machine chamber of the vehicle along with hydraulic pump, change-over valve etc.

In order to prevent the front working mechanism from hitting against surrounding buildings or other structures as it is turned in different directions during a ground working operation in a limited space, it is necessary to minimize the radius of turns of the upper rotary body as small as possible. In this connection, there have been developed the so-called ultra-mini turn type hydraulic power shovels which are arranged to have a turn radius within the breadth of the upper rotary body. Disclosed in Japanese Laid-Open Patent Specification H7-243223 is a typical ultra-mini turn type hydraulic power shovel. This prior art ultra-mini turn type hydraulic power shovel is arranged in the manner as will be described below with reference to FIGS. 9 through 13.

Referring first to FIG. 9, indicated at 1 is a base carrier of the machine, and at 2 is an upper rotary body. The base carrier 2 is constituted by a crawler type carrier having a pair of crawler belts 3 along the opposite lateral sides thereof. The upper rotary body 2 is rotatably supported on the base carrier 1 through a swivel base 4. Mounted on top of a frame 5 of the upper rotary body 2 is an operator's cab 6 which is equipped with a driver's seat for an machine operator, along with operating levers and other manual operating or control means. The front working mechanism 7 is largely constituted by a boom 8, an arm 9 and a bucket 10, and provided on the part of the upper rotary body 2. In this instance, as shown in FIG. 10, the operator's cab 6 and the front working mechanism 7 are located side by side in left and right front sections of the upper rotary body 2. Further, denoted at 11 is a machine chamber to accommodate therein hydraulic cylinders which serves as drive means for the front working mechanism, along with an engine, a hydraulic pump, change-over valves and an operating fluid tank for supplying pressure oil to hydraulic actuators such as hydraulic motors or other drive means for vehicle driving and rotating mechanisms of the machine. The machine chamber 11 extend from the rear side of the operator's cab 6 toward a mount base of the front working mechanism 7.

In this case, instead of being directly connected to the upper rotary body 2, the front working mechanism 7 is mounted on a swing post 12 which is connected to the frame 5 of the upper rotary body 2. This swing post 12 is provided for swinging motions of the front working mechanism 7, that is to say, for turning the front working mechanism 7 in the horizontal direction. In this regard, FIG. 11 shows arrangements of a boom foot portion where a base end portion of the boom 8 is connected to the swing post 12. The swing post 12 is horizontally swivellably connected to a vertical swing shaft 13 which is provided on the frame 5 of the upper rotary body 2. The swing shaft 13 is divided into upper and lower portions for passage therethrough of a hydraulic conduit pipe 14. Although not shown in the drawings, a swing drive hydraulic cylinder is connected between the swing post 12 and the upper rotary body 2 in such a way that the swing post 12 is turned through a predetermined angle in the horizontal direction by actuating the swing drive hydraulic cylinder.

The front working mechanism 7 is constituted by the boom 8, arm 9 and bucket 10, which are driven by boom operating hydraulic cylinder 15, arm operating hydraulic cylinder 16 and bucket operating hydraulic cylinder 17, respectively. Proximal ends of the boom 8 and the boom operating cylinder 15 are pivotally connected by pins 18 and 19 to a bracket 12*a* which is provided on the swing post 12, respectively. The other end of the boom operating cylinder 15 is pivotally connected to the boom 8 by a pin 20, so that the boom 8 is turned up and down through operation of the boom operating cylinder 15. In turn, the arm 9 is pivotally connected to the boom 8 by a pin 21, and opposite ends of the arm operating cylinder 16 are pivotally connected to the boom 8 and arm 9 by pins 22 and 23, respectively. Accordingly, the arm 9 can be turned up and down relative to the boom 8 through operation of the arm operating cylinder 16. Further, the bucket 10 is pivotally supported at the fore end of the arm 9 through a pin 24, while opposite ends of the bucket operating cylinder 17 are pivotally connected to the arm 9 and bucket 10 by pins 25 and 26, respectively. Accordingly, the bucket 10 can be turned up and down by operation of the bucket operating cylinder 17.

In this instance, the boom 8 is divided into upper and lower parts, namely, into a lower boom 8L which is pivotally connected to the swing post 12 by the pin 18 and an upper boom 8U which is pivotally connected to the arm 9 by the pin 21. Further, the lower boom 8 has its fore end portion pivotally connected to a base end portion of the upper boom 8U by a pin 27. The pin 20 which pivotally connects the boom operating cylinder 15 is provided on the part of the lower boom 8L. Accordingly, the term "boom foot portion" refers to a foot portion of the lower boom 8L which is pivotally connected to the swing post 12 by the pin 18.

Denoted at 28 are a pair of cross-links which function to control the open angle between the lower and upper booms 8L and 8U. The cross-links 28 are each constituted by a pipe- or rod-like member, and extended along the opposite lateral sides of the boom 8. Proximal ends of these cross-links 28 are pivotally supported by a pin 29 on and between a pair of brackets 12*a* which are erected on the swing post 12. The other ends of the cross-links 28 are pivotally connected to base end portions of the upper boom 8U by a pin 30, more particularly, to lateral sides of a base end portion where the upper boom 8U is connected to the lower boom 8L. As seen particularly in FIG. 12, in a maximum lifted position of the boom 8, the center axis of the cross-link 28, that is to say, a line X1 which connects the pins 29 and 30 of the cross-link 28 is intersected by a line X2 which connects pins 18 and 27 of the lower boom 8L.

With the arrangements as described above, when the boom 8 is lifted up and down, the lower boom 8L is vertically turned about the pin 18 which pivotally connects the lower boom 8L to the swing post 12. At this time, the cross-links 28 are turned up and down in interlinked relation with the movements of the boom 8, about the pin 29 instead of the pin 18. Namely, the pin 27 which pivotally connects the lower and upper booms 8L and 8U and the pin 30 at the other ends of the cross-links 28 are turned along arcuate loci of movement T1 and T2, respectively, which have the respective centers at distantly separate points. In addition, the length of the line X1 between the pins 18 and 27 (the radius of the arcuate locus T1) differs from that of the line X2 between the pins 29 and 30. It follows that the arcuate loci T1 and T2 are different from each other in center position and radius.

As shown in FIG. 12, the pin 29 is located in a position which is closer to the pivoting point and slightly lower than that of the pin 18, so that the line X2 has a greater length than the line X1. As a consequence, within the range of up and down movements of the boom 8, the loci T1 and T2 of the pins 27 and 30 intersect with each other twice as the boom 8 is moved from an uppermost lifted position down to a lowermost position. On the other hand, the fore end of the boom 8, namely, the pin 21 which pivotally connects the upper boom 8U and arm 9 draws a locus T3 of a non-circular curve.

As seen in FIG. 9, the boom 8 can be lifted up into the uppermost position to assume a rotating posture as indicated by solid line, or lifted down into the lowermost position to assume a deep-excavating posture as indicated by one-dot chain line or to assume a maximum outreaching posture as indicated by two-dot chain line. In ground excavating operations, normally the boom 8 comes into contact with the ground surface when put in or when in the vicinity of the maximum outreaching posture. In the deep-excavating posture, the depth-wise position of the bucket 10 determines the possible excavation range. In excavating operations, the front working mechanism 7 is largely stretched out in the forward direction when put in or in the vicinity of the maximum outreaching posture, minimizing the open angle between the lower and upper booms 8L and 8U of the boom 8, that is to say, folding and bending the boom 8 as a whole to a greater degree thereby increasing the angle with the ground surface to secure a greater excavation depth. On the contrary, in the rotating posture, for the purpose of receding the front working mechanism 7 into a compact form as a whole and for minimizing the radius of turns, the boom 8 is put almost in an upright position by increasing the open angle between the lower and upper booms 8L and 8U as much as possible.

This is the reason why the open angle of the lower and upper booms 8L and 8U is varied according to the movements of the boom 8. The cross-links 28 are pivotally connected between the upper arm 8U and the brackets 12*a* of the swing post 12 in such a way that the point of pivotal connection of the cross-links 28 with the upper boom 8U draws the arcuate locus T2 which is different from the arcuate locus T1 of the point of pivotal connection of the lower boom 8L with the upper boom 8U, thereby varying the open angle between the lower and upper booms 8L and 8U as the boom 8 is lifted up and down. Speaking on the basis of an open angle which is taken by the lower and upper booms 8L and 8U at an intersecting point of the loci T1 and T2, the open angle becomes smaller when the pivoting point on the locus T1 is located outside the arc of the locus T2 and becomes larger when the pivoting point on the locus T2 is located outside the arc of the locus T1.

Therefore, as shown in FIG. 12, when the boom 8 is lifted down, the loci T1 and T2 are intersected with each other at a point immediately before the maximum outreaching position, and, from that point, the pin 27 is positioned outside the locus T2 all the way to minimize the open angle between the lower and upper booms 8L and 8U until the deep-excavating position is reached. On the other hand, as the boom 8 is lifted up from the maximum outreaching position to the rotating position, the position of the pin 30 is displaced to the outside of the locus T1. The center positions and radii of the loci T1 and T2 are determined such that the positions of the pins 27 and 30 are set apart from each other to a maximum degree when the boom 8 takes the maximum outreaching position. By so doing, the boom 8 as a whole can be bent to a greater degree at the time of excavating operations, with a smaller open angle between the lower and upper booms 8L and 8U (e.g., angle a in the maximum outreaching position or angle β in the deep-excavating position) to secure a sufficient excavation depth. On the contrary, when the boom 8 is lifted into the rotating position, the lower and upper booms 8L and 8U are spread to a greater angle γ or into an almost straight position to back off the front working mechanism into a compact form. As a consequence, the front working mechanism is contracted to have a small radius of turns S, which falls within the area of the upper rotary body 2 as indicated in FIG. 9, and can be rotated with fewer possibilities of hitting against building walls or other structures which may exist in the vicinity of the upper rotary body 2, particularly when structures are substantially vertical building walls or the like.

In a hydraulic power shovel of the ultra-mini turn type which is arranged as described above, instead of being directly mounted on the upper rotary body 2, the front working mechanism 7 is mounted on the swing post 12 which is protruded to the outside from the upper rotary body 2, for permitting efficient side ditch excavation. Namely, when the hydraulic power shovel as a whole is put in the posture as shown in FIG. 13, the bucket 10 is located in an offset position which is almost in line with one side of the upper rotary body 2. In this position, for example, the front working mechanism 7 is operated to excavate a side ditch along one side of a road or the like, smoothly by means of the bucket 10, while moving the vehicle in a predetermined direction.

Normally, the hydraulic power shovel is in the position as shown in FIG. 10, and shifted to the side-ditch excavating position by swinging the front working mechanism 7 on the swing post 12 through a predetermined angle relative to the upper rotary body 2 as indicated by arrow P in the same figure and, in this state, turning the upper rotary body 2 as a whole in the opposite direction as indicated by arrow Q.

In the above-described prior art, the cross-links 28 are provided on the opposite sides of the boom 8. Therefore, each cross-link 28 is projected from the lateral side of the boom 8, more specifically, from the lateral side of a lower part of the lower boom 8L in the vicinity of the operator's cab, which is located on the upper rotary body 2 side by side with the front working mechanism 7, and machine operating means such as operating levers and operating pedals which are provided on the front side of the operator's cab although not shown in the drawings. Besides, in case the front working mechanism 7 is mounted on a swing post 12 to permit its swinging motions, the cross-links 28 are shifted to positions immediately in front of the operator's cab when the front working mechanism 7 is put in the side-ditch excavating position as shown in FIG. 13, arousing great oppressive sensations in the operator which is seated in the operator's cab for operation of the machine. Especially, in the case of a small-size hydraulic power shovel like the so-called "mini shovel" having the upper rotary body 2 arranged in a compact shape as a whole, the cross-links which are projected from the opposite lateral sides of the boom 8 can come into the way of the operator who is maneuvering the operation control means, restricting to develop excavation machines with a higher degree of compactness.

DISCLOSURE OF THE INVENTION

With the foregoing situations in view, it is an object of the present invention to provide an excavation machine having a cross-link connected to a boom of a front working mechanism in a way that it will not obstruct machine operations by an operator who is seated on a driver's seat side by side with the front working mechanism.

It is another object of the present invention to provide an ultra-mini turn type hydraulic power shovel having a cross-link attached to a boom of a front working mechanism in such a way as to improve controllability or maneuverability of operating means which are provided in an operator's cab of the machine.

It is still another object of the present invention to provide a cross-link arrangement for a boom, which is simplfied in construction and yet capable of effectively absorbing lateral bending loads which might result from the simplified cross-link arrangement.

In accordance with the present invention, the above-stated objectives are achieved by the provision of an excavation machine of the type including a base carrier, and an upper rotary body rotatably mounted on the base carrier and provided with a driver's seat and a front working mechanism in the proximity to each other, the front working mechanism including a boom, an arm and a bucket, the boom of the front working mechanism being constituted by a lower boom pivotally supported on a bracket on the base carrier, an upper boom pivotally connected to the fore end of the lower boom, a boom operating hydraulic cylinder connected to the lower boom, and a cross-link connected between the bracket and the upper boom, characterized in that the cross-link is located along one lateral side of the boom on the side away from the driver's seat.

In case a cross-link is provided at and along only one side of a boom, there may arise situations of biased imposition of loads, acting to impose lateral bending forces on the lower boom and subjecting same to greater stresses on the side facing the cross-link than on the opposite side. According to the present invention, for the purpose of suppressing or buffering such lateral bending stresses, the front working mechanism is provided with a lateral load buffer means which is constituted, for example, either by locating a boom operating hydraulic cylinder in a position which is shifted from a center axis of the lower boom by a predetermined distance in a direction away from the cross-link or by locating a center line of the lower boom in a position which is shifted from a center axis of a boom foot portion by a predetermined distance in a direction toward the cross-link.

In case the front working mechanism is swingably supported on a swing post on the upper rotary body, when the front working mechanism is switched into a side-ditch excavating position, the lower boom could be turned into a position immediately in front of the face of an operator or to a threatening distance. Therefore, it is extremely advantageous not to provide the cross-link on a lateral side of the lower boom which is located on the side of the operator. However, even in a case where the boom is not mounted on a swing post, an operator could receive oppressive sensations as long as a cross-link exists on the side of the operator's cab. Accordingly, the present invention is applicable not only to a swing type front working mechanism but also to a front working mechanism which is directly mounted on an upper rotary body of an excavation machine.

In the case of a swing type front working mechanism, a bucket can be located in a position further aside of a normal side-ditch excavating position by locating a center axis of the bucket in a position which is shifted from a center axis of a boom foot portion toward one side of the boom away from a driver's seat on the upper rotary body. Besides, in case a center axis of the boom proper is shifted aside from a center position of a boom foot portion of the lower boom in a direction away from the driver's seat, this shift from the center axis produces not only advantages on side-ditch excavating operations but also functions as a lateral bending load buffer means. Similar effects can be produced by an arrangement in which a center axis of the upper boom is located parallel with a center axis of the lower boom, from a boom foot portion to the pivotal connection with the upper boom, and in a position which is shifted aside from the center axis of the lower boom by a predetermined distance to a side away from the driver's seat on the upper rotary body.

The lower boom is in the form of a box structure consisting of four plates of different thicknesses welded or joined together substantially in a square shape in section. By using a thicker side plate on the side of the cross-link than a side plate on the opposite side of the box structure, the lower boom itself can function as the lateral bending load buffer means. In case the box structure of the lower boom is constituted by plates of different thicknesses in this manner, it is most rational to use a plate of the greatest thickness for the bottom plate, a plate of the secondly greatest thickness for the side plate located on the side of the cross-link, a plate of less thickness for the side plate located on the side away from the cross-link, and a plate of the smallest thickness for the top plate of the box structure.

BEST MODES FOR CARRYING OUT THE PRESENT INVENTION

Figure 1:
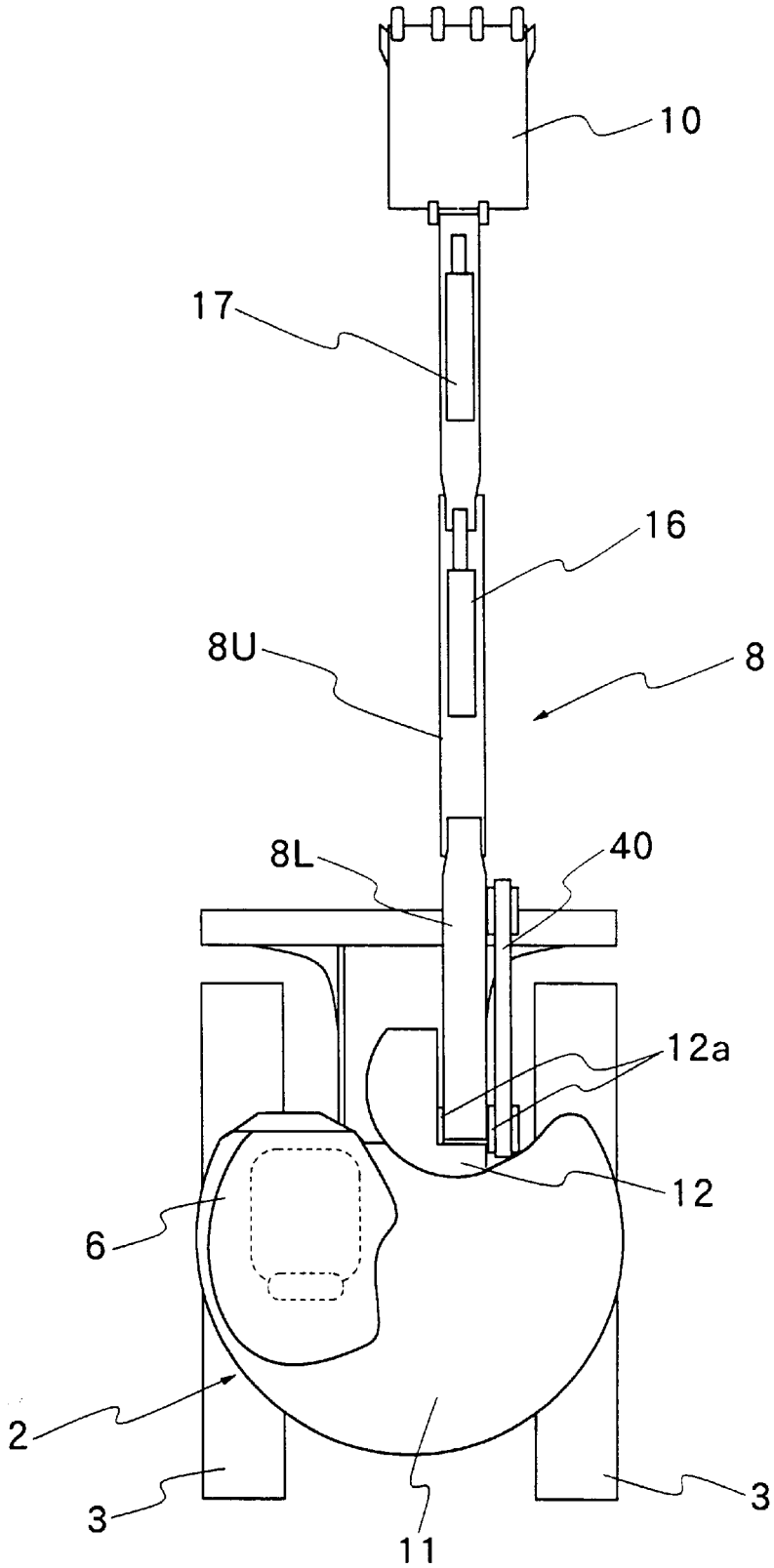
FIG. 1 is a plan view of a hydraulic power shovel shown as a typical example of an excavation machine according to a first embodiment of the invention.
Figure 2:
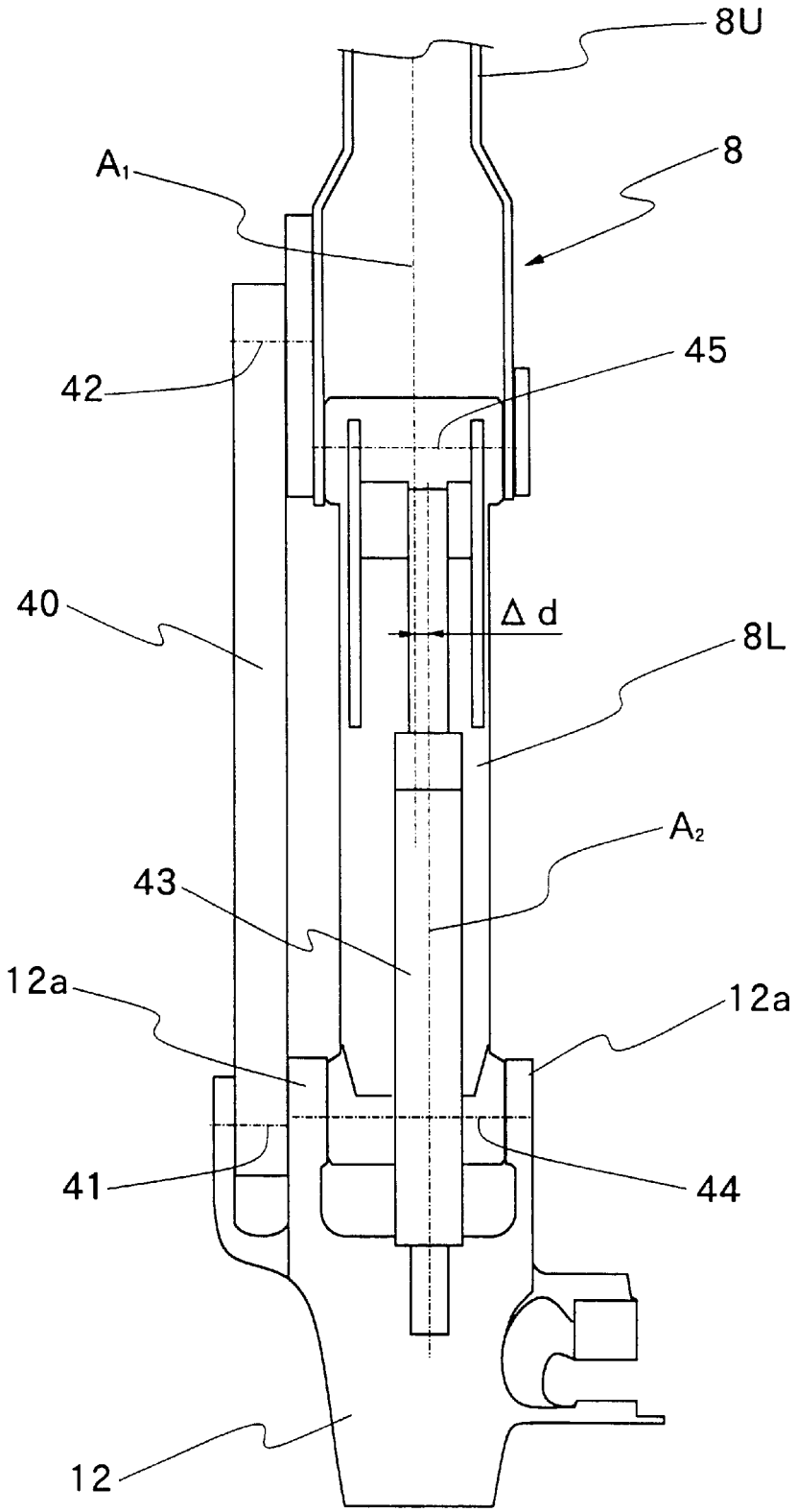
FIG. 2 is an outer view, taken from the front side of a boom portion of a front working mechanism of the first embodiment.

Hereafter, the present invention is described more particularly by way of its preferred embodiments with reference to the drawings. In the following description, those component parts which are common or equivalent with the counterparts of the above-described prior art are simply designated by common reference numerals without repeating same explanations. Shown in FIGS. 1 and 2 is a first embodiment of the present invention. More specifically, FIG. 1 shows in a plan view a hydraulic power shovel as an example of excavation machine, FIG. 2 is a boom of a front working mechanism in an outer view taken from the front side of the boom.

As seen in these figures, in general arrangements, the machine has no differences in particular from the prior art counterpart described hereinbefore, including a swing type front working mechanism 7 having a boom 8 comprised of a lower boom 8L and an upper boom 8U, and having a base end portion of the lower boom 8L pivotally supported on a bracket 12*a* of a swing post 12 through a pin 18. A cross-link 40 is pivotally connected between the bracket 12*a* and the upper boom 8U by pins 41 and 42, and opposite ends of a boom operating cylinder 43 is pivotally connected to the bracket 12*a* and the lower boom 8U by pins 44 and 45, respectively.

In this instance, however, a single cross-link 40 is provided at one lateral side of the boom 8. Namely, a cross-link 40 is provided only along the right lateral side of the boom 8, and not provided at the left lateral side of the boom 8, that is to say, not on the side of the operator's cab 6. In this single cross-link arrangement, the cross-link 40 should be of higher strength as compared the cross-link in the above-described conventional dual or double cross-link arrangement employing a pair of cross-links along the opposite sides of the boom 8.

When the front working mechanism is operated for ground working operations, axial forces are imposed on the lower boom 8L, including axial compressing forces (in excavating operations) or axial stretching forces (in craning operations). When axial compressing forces are imposed on the lower boom 41L, they tend to axially stretch the cross-link 42. Therefore, there occurs a bending moment acting to bend the lower boom 41L toward the cross-link 42. Namely, on such an occasion, an axial compressing force is exerted on the lower boom 41L on the side of the cross-link 42, while an axially stretching force is exerted on the opposite side of the lower boom 41L. As a result, the axial compressing stress and lateral bending stress act in the same direction and amount to large composite stress on the side of the cross-link 42, although these stresses are offset with each other to produce only small composite stress on the side away from the cross-link 42. Besides, when a stretching force is exerted on the lower boom 41L, the cross-link is compressed by the reaction force, and therefore the lower boom 41L is similarly subjected to a bending moment which will result in lateral bending stress. In this instance, the respective forces act in opposite directions, but the axial stress on the lower boom 41L becomes greater in those portions which are closer to the cross-link 42. Therefore, when the front working mechanism 40 is in operation, the lower boom 41L is constantly subjected to lateral bending forces, and the composite force of the bending force and the axial force acts in the maximum degree on the side of the cross-link 42.

According to the invention, a bending stress buffer means is provided for the purpose of suppressing or moderating lateral bending stresses of this nature. As a bending stress buffer means, a boom operating hydraulic cylinder 43 can be utilized. In a case where the front working mechanism is provided with one boom operating cylinder 43, normally it is mounted along a center line of the boom 8. However, in this embodiment of the present invention, in order to balance stresses, the boom operating cylinder 43 is located in a position which is shifted toward the side toward operator's cab 6, more specifically, the center axis A2 of the boom operating cylinder 43 is shifted aside from the center axis A1 of the lower boom 8L by Δd1 in a direction toward the operator's cab 6. By so doing, the acting point of the driving force of the boom operating cylinder 43 is shifted to one side of the center axis A1 of the lower boom 8L in a direction away from the cross-link 40 to produce a force which counteracts the lateral bending stress as would result from the single cross-link arrangement using only one cross-link 40 at one side of the lower boom 8L. As a consequence, stresses are suitably dispersed to prevent concentration of stresses in the lower boom 8L, especially concentration of lateral bending stresses in lower boom portions which are in the vicinity of or which directly face the cross-link 40.

Figure 13:
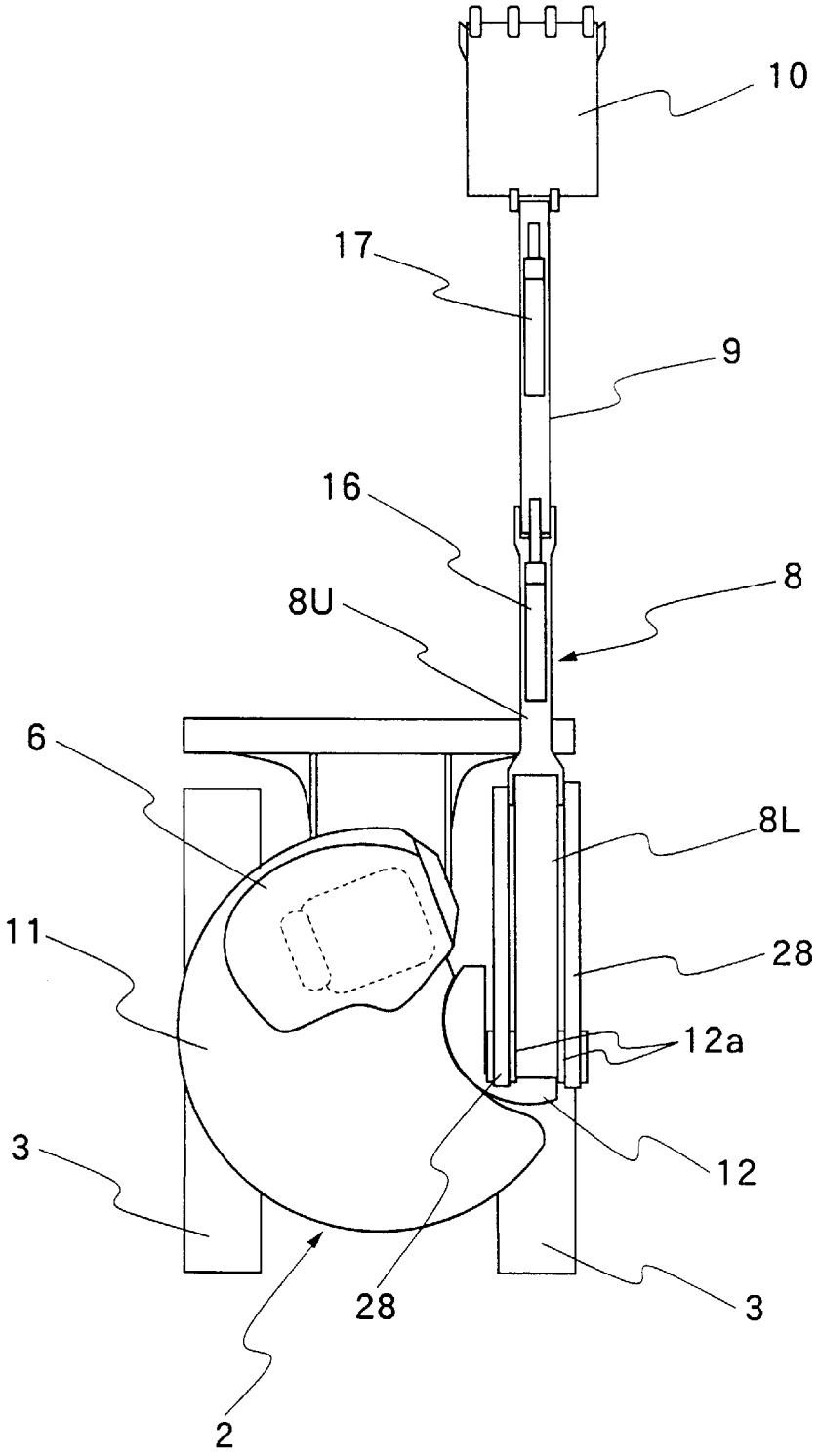
PRIOR ART FIG. 13
FIG. 13 is a plan view of the conventional hydraulic power shovel in a side-ditch excavating position.

As described above, the cross-link 40 is provided only at one side of the boom 8 and on the side away from the operator's cab 6 which is provided on the upper rotary body 2 side by side with the front working mechanism 7. Therefore, the operator who is seated in the operator's cab 6 can operate the machine smoothly without experiencing any oppressive sensations. Especially, when the front working mechanism is put in the side-ditch excavating position with a lateral side of the boom 8 disposed substantially in face to face relation with the front side of the operator's cab 6 in the manner as shown in FIG. 13, there is no such projecting obstacles on the near lateral side of the boom 8 as would impair machine controllability by the operator. This is particularly advantageous in the case of small excavation machines like the so-called mini-shovels which usually have the machine operating means in a limited space in front of the operator's cab 6. Otherwise, a component which is projected on the side of the operator's cab could interfere with movements of certain machine operating means. Problems of this sort are precluded by elimination of the cross-link on the side of the operator's cab 8. As a result, it becomes possible to further downsize the excavation machine into a more compact form.

Figure 3:
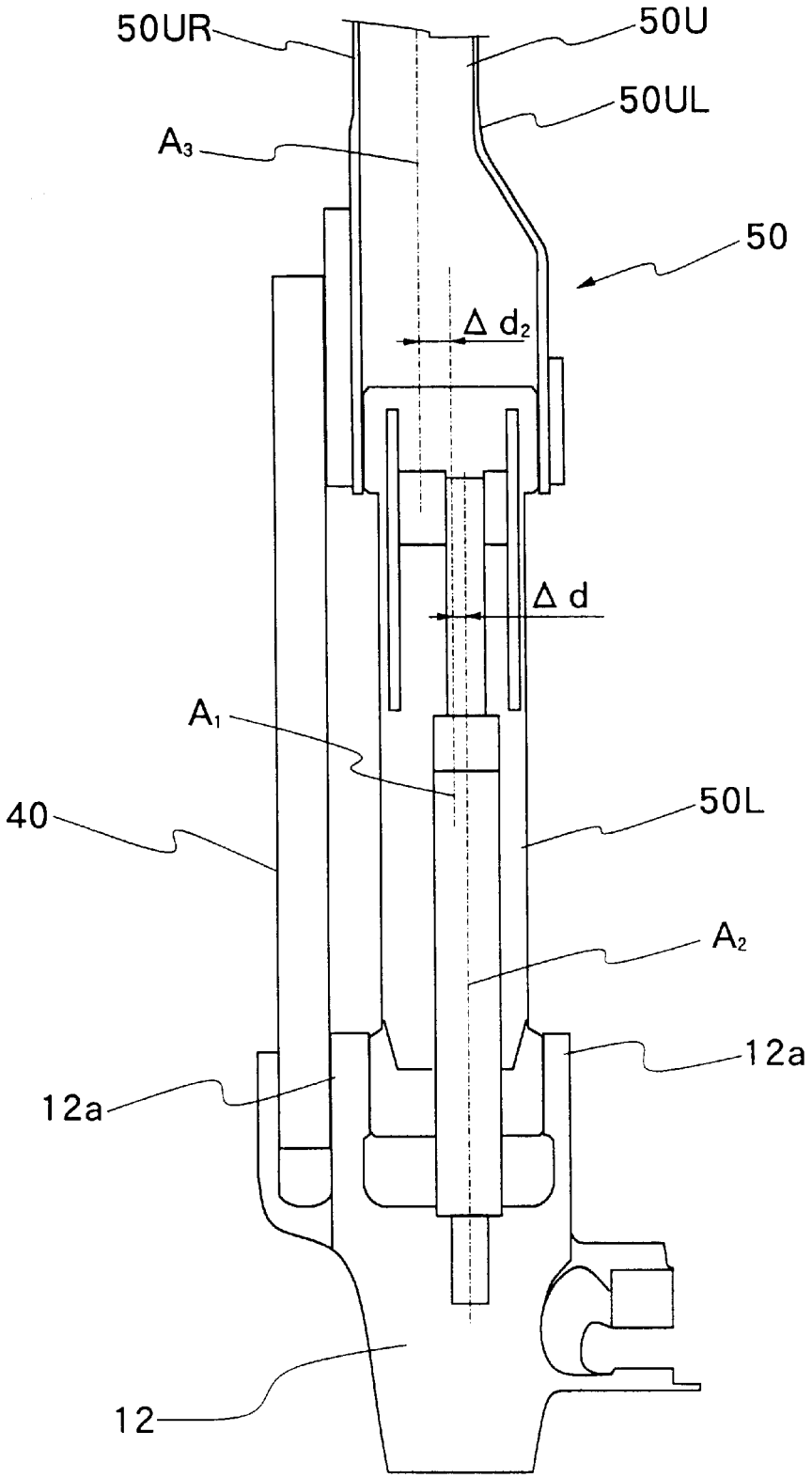
FIG. 3 is an outer view, taken from the front side, of a boom portion of a front working mechanism according to a second embodiment of the present invention.

Referring now to FIG. 3, there is shown a second embodiment of the present invention, in which the component parts common or equivalent with the foregoing first embodiment are designated by common reference numerals. In the same manner as in the foregoing first embodiment, a boom operating hydraulic cylinder 43 is mounted in a shifted position relative to the center axis A1 of a lower boom 50L, more specifically, center axis A2 of the boom operating cylinder 43 is shifted by Δd1 to one side of the center axis A1 of the lower boom 50L in a direction toward the operator's cab 6. In addition, in this case, the lower boom 50L is provided with a foot portion which is extended in a rectilinearly straight form from a proximal end portion which is pivotally supported on the paired brackets 12*a* of the swing post 12 by the pin 18. The center axis A3 of the upper boom 50U, which is disposed in parallel relation with the center axis A1 of the lower boom 50L, is located in a position which is shifted aside from the center axis A1 by Δd2 away from operator's cab 6 on the upper rotary body, namely, to a side toward the cross-link 40. As a consequence, the center axis forward of the upper boom 50U, inclusive, is prevented from being deviated from the center axis A1 of the lower boom 50L by Δd2 in the outward direction, that is to say, in a direction away from the operator's cab 6.

In this instance, in order to shift the center axis A3 of the upper boom 50U from the center axis Al of the lower boom 50L by Δd2, inner and outer or left and right side plates 50UL and 50UR which constitute the box structure of the upper boom 50U are formed in different shapes. Namely, of the lower and upper booms 50L and 50U, which are each comprised of a box structure, the lower boom 50L is normally formed in a larger size than the upper boom 50U in sectional dimensions, particularly in width mainly because of differences in required strength. Therefore, of the two side plates 50UL and 50UR of the upper boom 50U, the right side plate 50UR on the side of the cross-link 40, or in other words, on the side away from the operator's cab 6 is formed in a rectilinear shape while the left side plate 50UL is largely curved toward the other side plate 50UR in the forward direction in the vicinity of its pivotally connected end portion, for adjusting the upper boom 50U into a predetermined width.

With the arrangements just described, the center of gravity of the lower boom 50L is located almost in an equidistant position from or in an intermediate position between the cross-link 40 and the boom operating cylinder 43, so that the lower boom 50L is supported at its opposite sides by the cross-link 40 and the boom operating cylinder 43 almost in the same conditions as in the dual or double cross-link arrangement, thereby substantially preventing imposition of lateral bending stress on the lower boom 50L.

Figure 4:
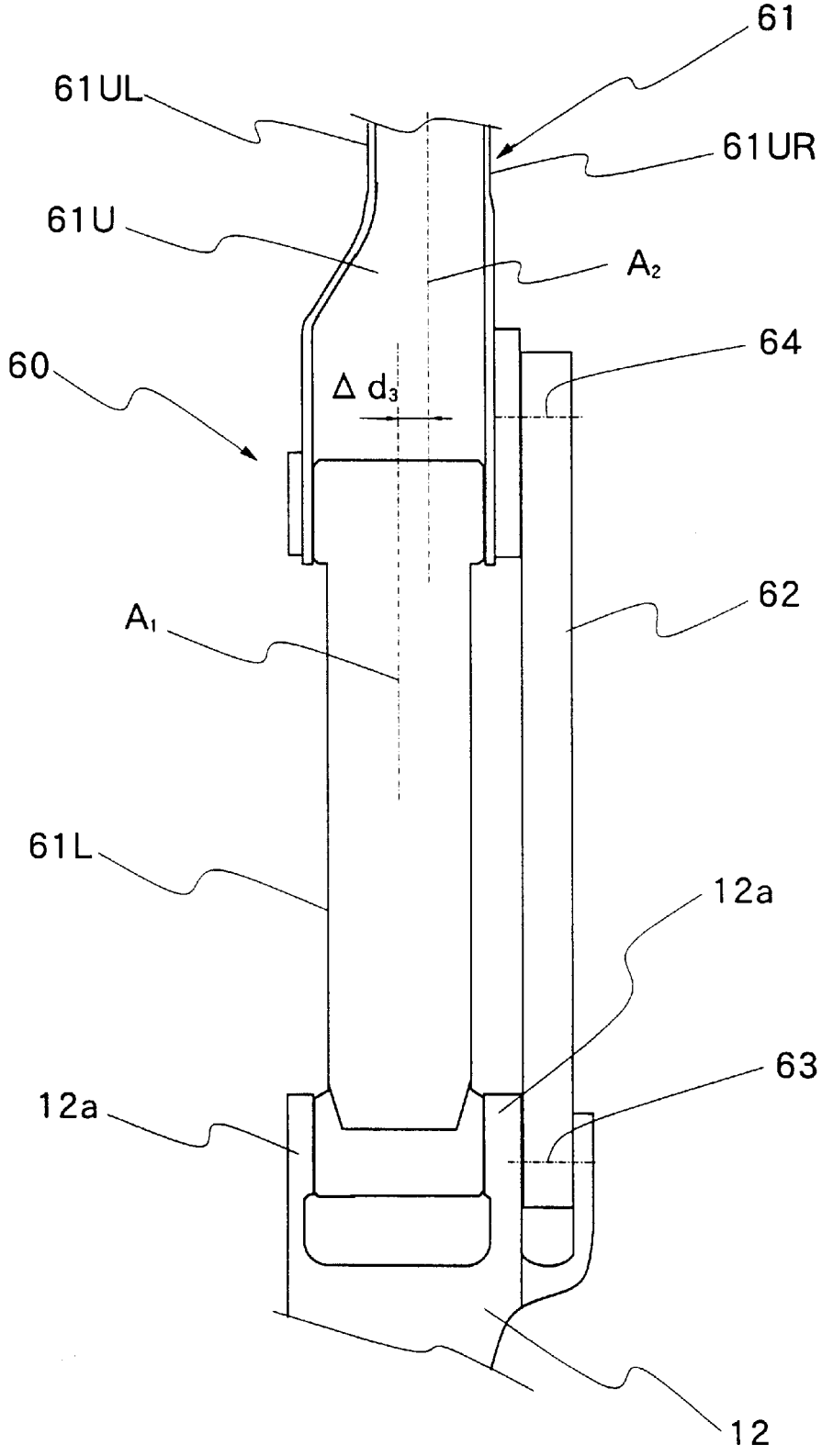
FIG. 4 is a plan view of a base end portion of a boom employed in a third embodiment of the present invention.
Figure 5:
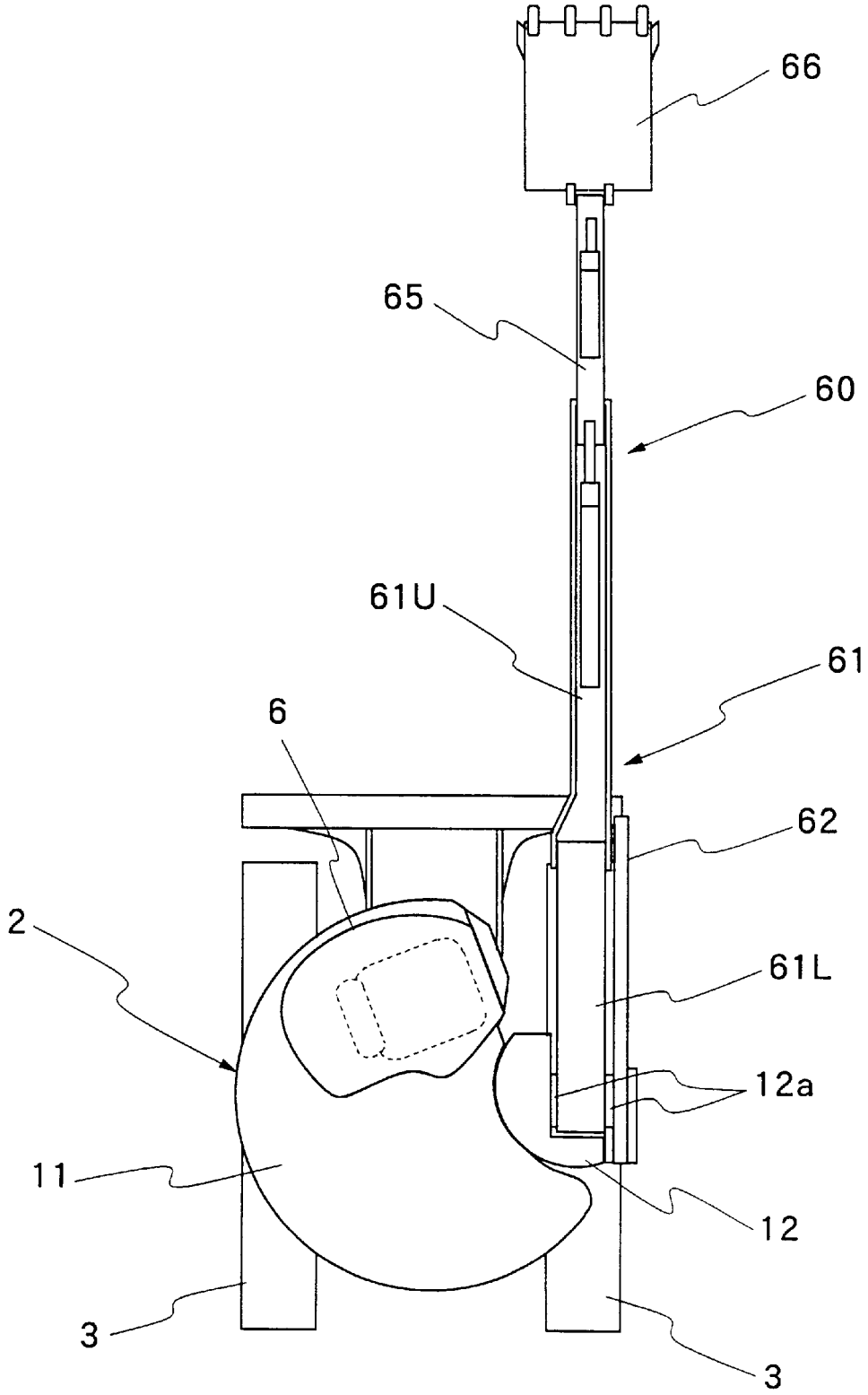
FIG. 5 is a plan view of a hydraulic power shovel in a side-ditch excavating operation by the use of the boom of FIG. 4.

Illustrated in FIGS. 4 and 5 is a third embodiment of the present invention, similarly having one cross-link attached to one side of a boom in such a manner as to moderate lateral bending stresses which might be imposed on the lower boom and as to permit an increased degree pf offsetting of the bucket to ensure smooth side-ditch excavating operations.

More specifically, as shown particularly in FIG. 4, this embodiment employs a front working mechanism 60, having a boom 61, which is composed of a lower boom 61L and an upper boom 61U, and a cross-link 62 which is pivotally connected between the swing post 12 and the upper boom 61U, in the same manner as in the above-described second embodiment.

Center axis A1 of the lower boom 61L is extended as a straight line throughout the foot portion of the boom, that is to say, throughout almost the entire length of the lower boom 61L from the proximal end portion which is pivotally supported on the paired brackets 12*a* of the swing post 12 by a pin 63. The center axis A2 of the upper boom 61U is extended in parallel relation with the center axis A1 of the lower boom 61L and set in a shifted position relative to the center axis A1, that is to say, set in a position which is shifted by $\Delta d_3$ in a direction away from the operator's cab 6 on the upper rotary body 2, in other words, in a direction toward the cross-link 62. As a consequence, the center axis forward of the upper boom 61U, that is to say, the center axes of the arm 65 and bucket 66 are shifted aside from the center axis A1 of the lower boom 61L by $\Delta d_3$ in the outward direction.

In this instance, in order to set the center axis A2 of the upper boom 61U in a position which is shifted aside left and right side plates 61UL and 61UR of the box structure, which constitutes the upper boom 61U, are formed in different shapes. More particularly, of the lower and upper booms 61L and 61U which are each constituted by a box structure, the lower boom 61L is formed in a larger size than the upper boom 61U in sectional dimensions, particularly in width because of differences in required strength as mentioned above. Therefore, of the two side plates 61UL and 61UR of the upper boom 61U, the right side plate 61UR which is located on the right side, that is to say, on the side away from the operator's cab 6 or on the side of the cross-link 62 is formed in a rectilinearly straight form, while the left side plate 61UL at the opposite side of the upper boom 61U is largely curved toward the right side plate 61UR in the forward direction from a point in the vicinity of the proximal end portion which is pivotally connected to the lower boom 61L, thereby adjusting the upper boom 61U into a predetermined width.

In this manner, the upper boom 61U, which is connected to the lower boom 61L, has its center axis A2 shifted aside by Δd2 in the direction of the cross-link 62 from the center axis A1 of the lower boom 61L. As a result, the center of gravity of the boom 61 as a whole as well as the center of gravity of the lower boom 61L, which is supported by the single cross-link arrangement, is shifted aside toward the cross-link 62. This shift minimizes the bending moment acting on the lower boom 60L to moderate the lateral bending stresses to be imposed on the lower boom 61L, thanks to the effects of the lateral bending stress buffer means which is constituted by the shift of the center axis A2 of the upper boom 61U. Consequently, the lower boom 61L can be moved more smoothly at the time of lifting the boom 61 up and down, and prevented from undergoing deformations which might otherwise result from repeated loading.

By adopting the single cross-link arrangement as described above, when the front working mechanism 60 of the hydraulic power shovel is put in the side-ditch excavating position as shown in FIG. 5, the degree of offsetting of the bucket 66 can be increased by Δd3 as compared with an excavation machine which have the respective components of the front working mechanism in an aligned state in the axial direction. This precludes the possibilities of the base carrier 1 being contacting surrounding structures, and permits the operator to control the machine smoothly even in side-ditch excavating operations in which normally the operator is required to drive the vehicle in the close proximity of a building or other standing structures.

Further, in order to secure higher strength, the steel plates or plate members which constitute the box structures should be as straight as possible in outer shape. It is normally the case that, when formed into a bent shape, the strength of steel plates drops as a result of straining. As mentioned hereinbefore, of the two side plates 61UL and 61UR of the upper boom 61U, one side plate 61UR is of a straight form which does not need a bending operation, so that it contributes to improving the strength of the upper boom 61U. Besides, because of the simplicity of necessary forming and machining operations, it also becomes possible to cut the production cost of the upper boom 61U as a whole.

Figure 6:
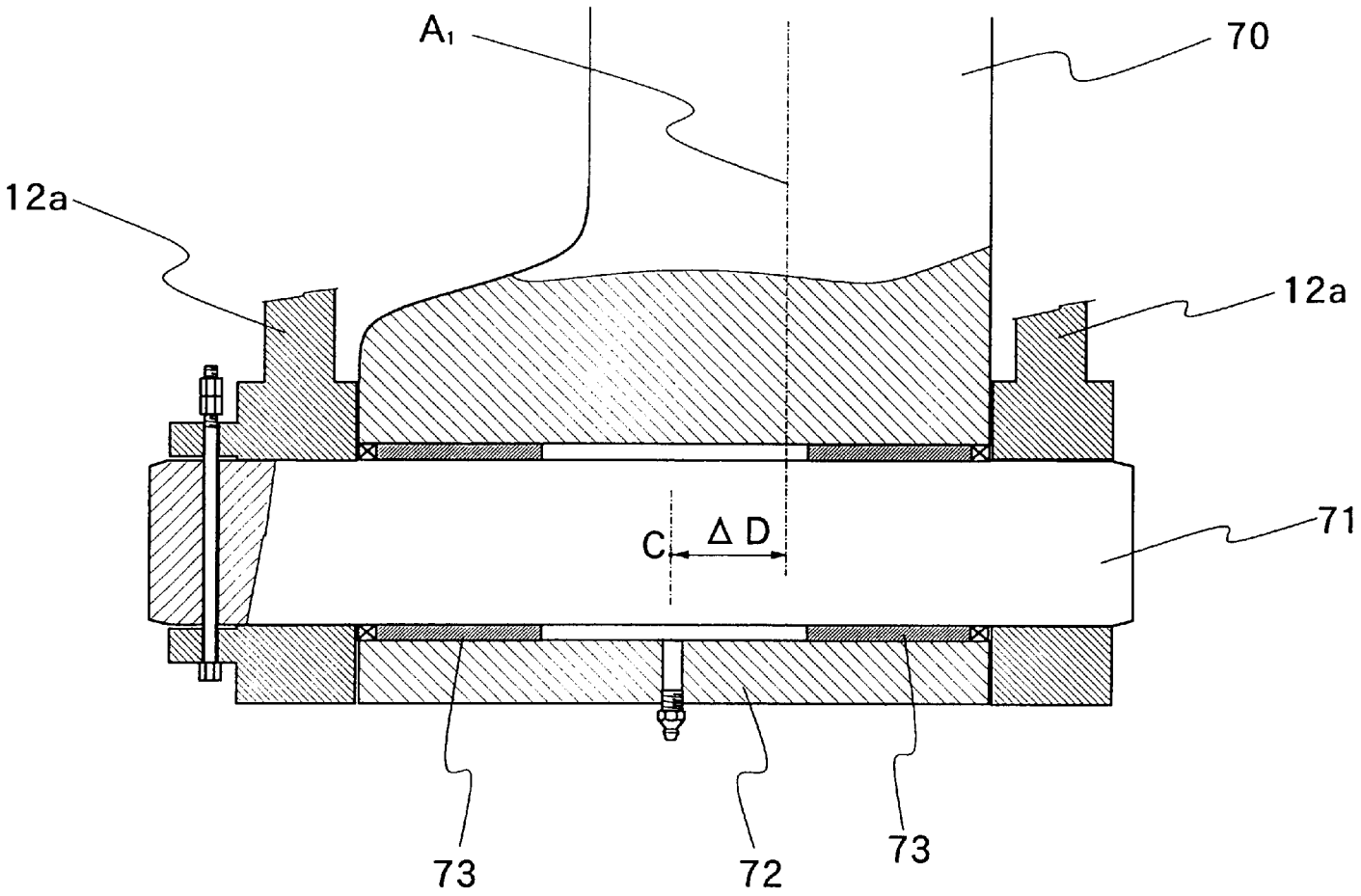
FIG. 6 is a sectional view of a boom mount portion including a foot portion of a boom according to a fourth embodiment of the present invention.

Referring to FIG. 6, similar effects can be obtained by shifting the center axis A1 of a lower boom 70 to the side of the cross-link (which is located on the right side although not shown in the drawing) relative to the center position C of a boom foot portion, instead of shifting the center axis of the upper boom relative to that of the lower boom. More particularly, the lower boom 70 is connected to a pin 71 which is inserted in and between the paired brackets 12*a* of the swing post 12, and, in order to connect the lower boom 70 rotatably to the pin 71, a boss portion 72 which is extended from the lower boom 70 is slidably fitted on a pin 71 through a bush 73. Movements of the boss portion 72 in the axial direction of the pin 71 are restricted by the brackets 12*a*. Accordingly, the center C of the boom foot portion is located in an intermediate position between the brackets 12*a*, that is to say, located at the center of the boss portion 72 in the axial direction of the pin 71.

The lower boom 70 of a box structure except the boss portion 72 which may be of a non-box structure having a pin fitting hole bored therethrough in a direction perpendicular to the center axis Al of the lower boom 70 for connectin to the pin 71. Accordingly, the lower boom 70 is not necessarily required to have a uniform structure from its fore end to the boss portion 72. In this case, the center C of the boom foot portion is located in a position which is shifted aside in the direction of the cross-link by ΔD from the center axis A1 of the lower boom 70. With such an arrangement, it becomes possible to increase the amount of offsetting of the bucket and to moderate lateral bending stresses by the shift of the center of gravity of the whole boom toward the cross-link.

Figure 7:
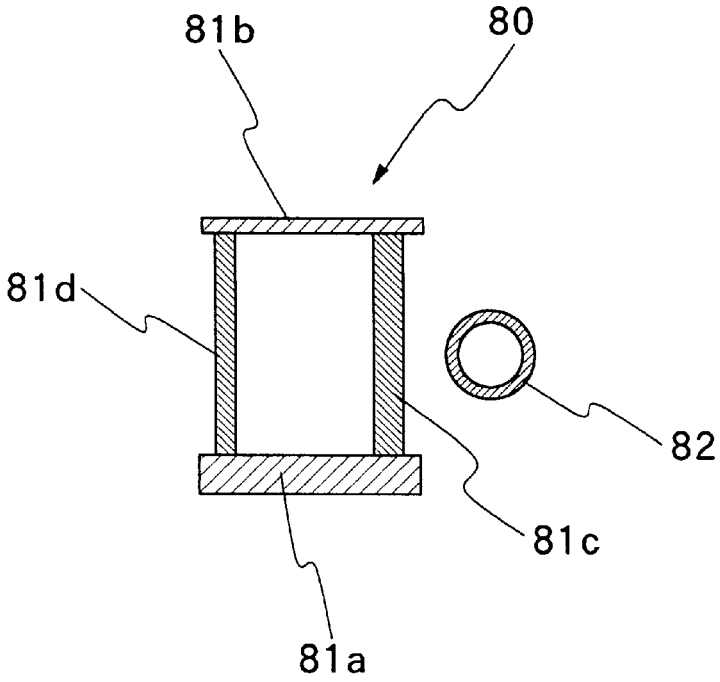
FIG. 7 is a sectional view of a lower boom according to a fifth embodiment of the present invention.
Figure 8:
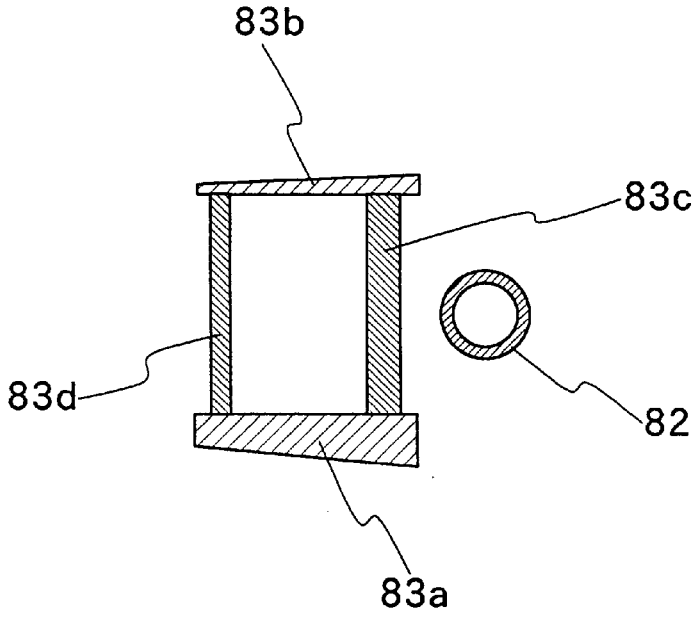
FIG. 8 is a sectional view of a lower boom according to a sixth embodiment of the present invention.
Figure 9:
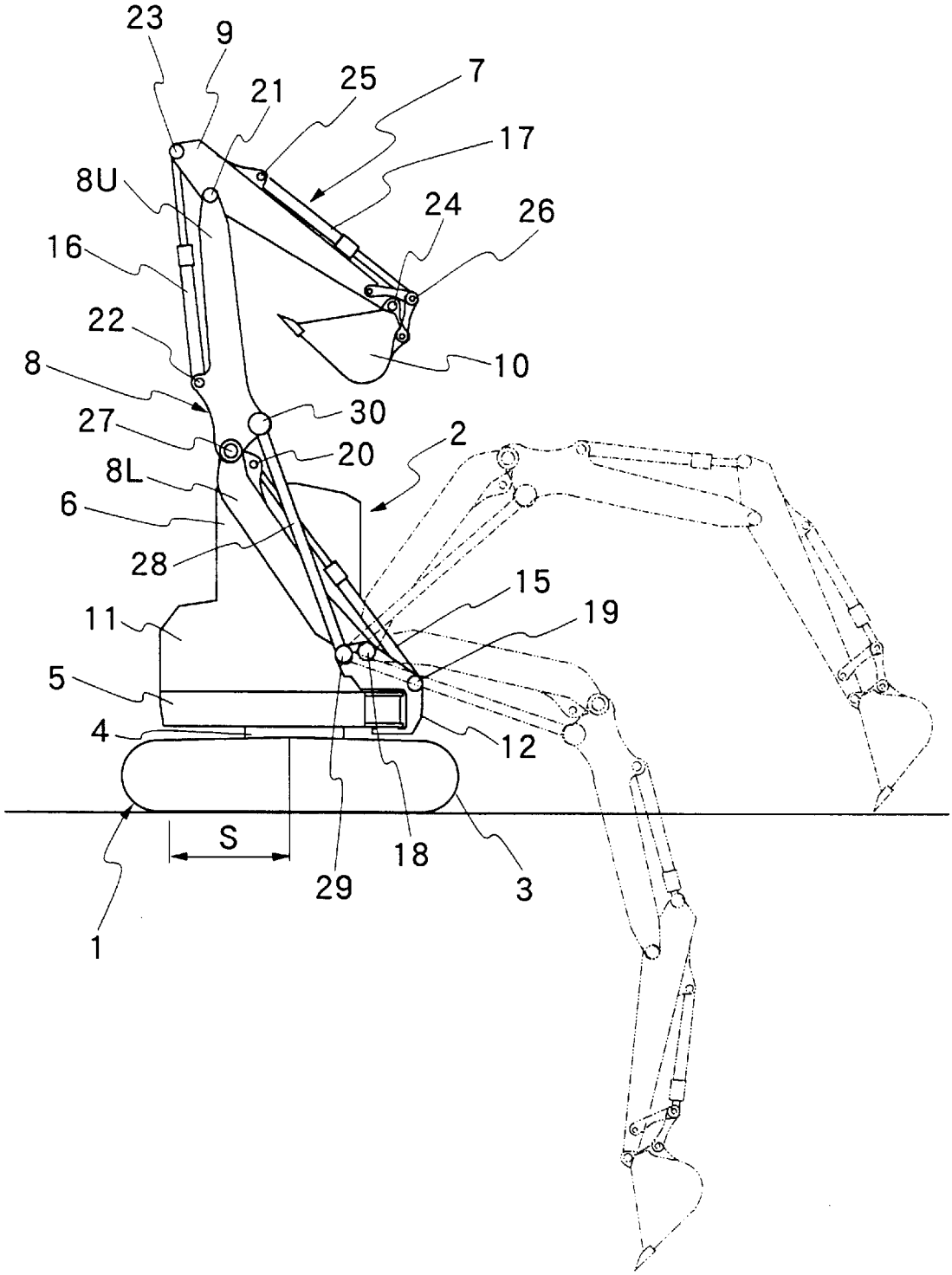
PRIOR ART FIG. 9
FIG. 9 is a front view of a conventional swing type hydraulic power shovel.
Figure 10:
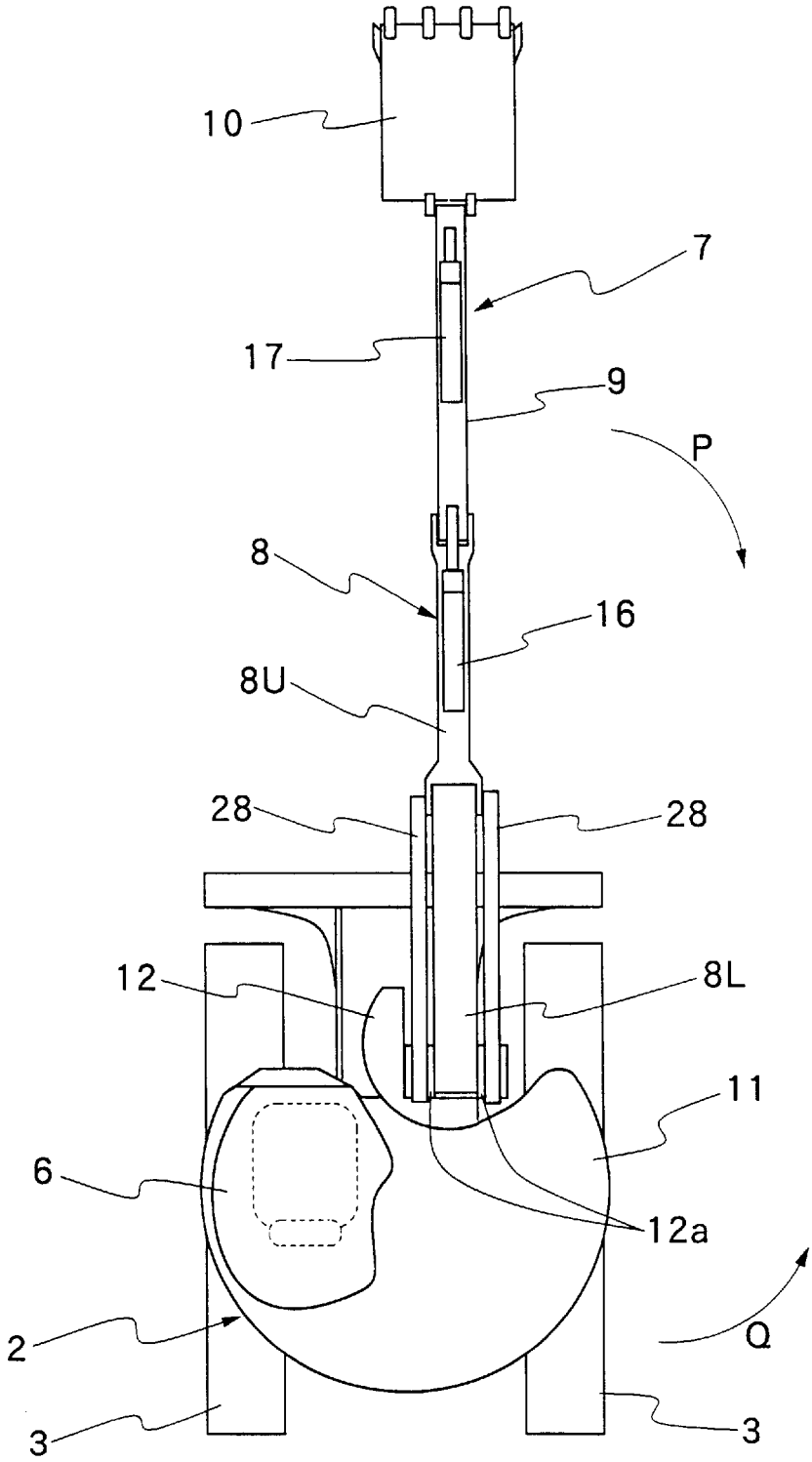
PRIOR ART FIG. 10
FIG. 10 is a plan view of the power shovel of FIG. 9.
Figure 11:
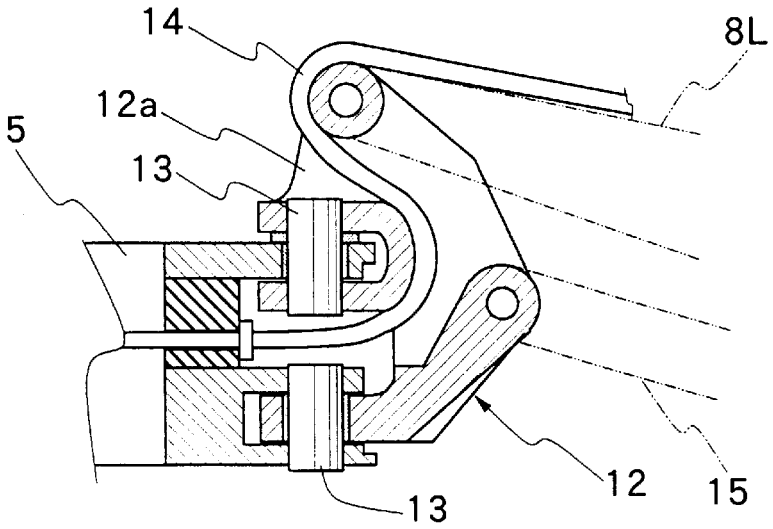
FIG. 11 is a schematic illustration showing the construction of a swing mechanism.
Figure 12:
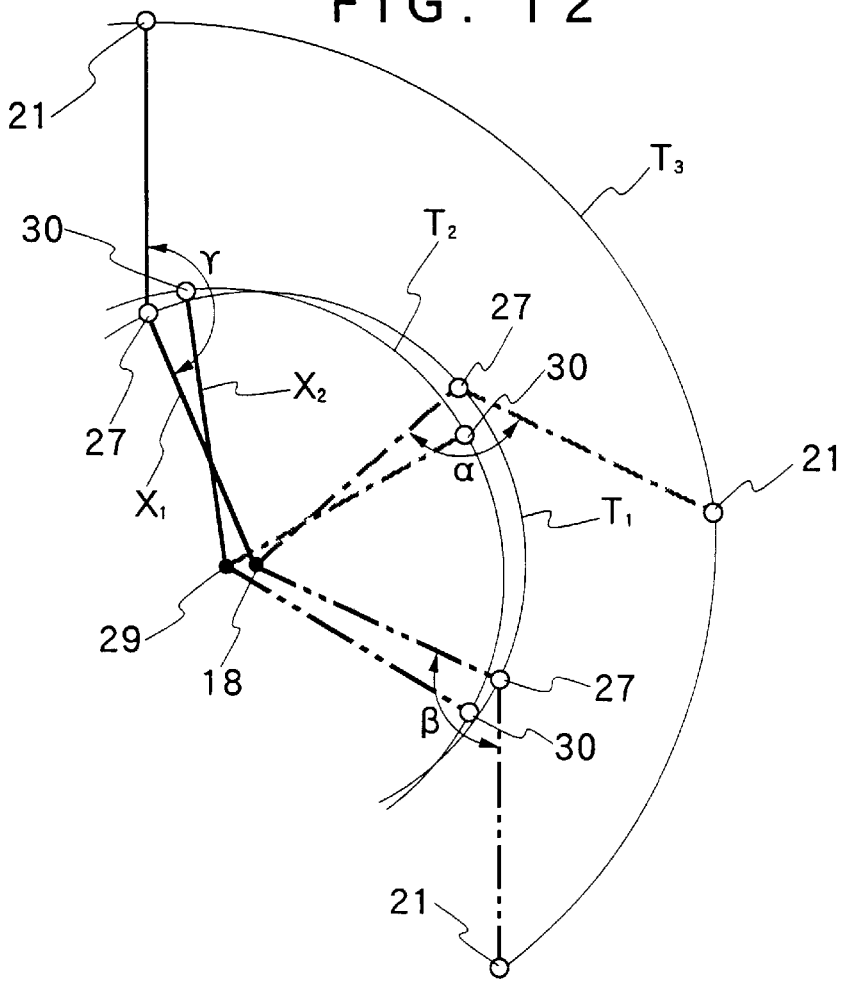
FIG. 12 is an operational diagram explanatory of movements of a front working mechanism with cross-links.

Furthermore, in the case of a boom of the single cross-link arrangement having only one cross-link at one side of a boom as shown in FIGS. 7 and 8, the lower boom structure can be utilized as a lateral bending stress buffer means which serves to moderate the lateral bending stress on the lower boom and ensure smooth movements of the lower boom while preventing its deformations.

As mentioned hereinbefore, it has been the general practice to employ a lower boom 80 of light weight and of a box structure for the purpose of improving structural strength (the same applies to the upper boom and arm). More particularly, the lower boom 80 usually has a sectional shape as shown in FIG. 7. As clear from that figure, the lower boom 80 is constituted by four plates such as steel plates 81*a* to 81*d* which are welded together or securely joined together to form a box-like structure. Of the four plates 81*a* to 81*d* of the box structure, the boom operating cylinder is connected to the plate 81*a* which makes the lower or bottom plate of the lower boom 80. The plate 81*b* forms the top plate which is located at the opposite side from the bottom plate 81*a*. Further, the plate 81*c* forms one of two side plates of the lower boom 80, in this case, a side plate on the right side of the lower boom 80, and a cross-link 82 is located along this right side plate 81*c*. The last plate 81*d* is located at the left side of the lower boom 80 in face to face relation with an operator's cab.

As seen in FIG. 7, all of the respective plates 81*a* to 81*d* of the lower boom 80 are different in thickness. Normally, the lower plate 81*a* is constituted by a plate of the greatest thickness, the right side plate 81*b* by a plate of the second greatest thickness, the left side plate 81*c* by a plate of less thickness, and the top plate 81*d* by a plate of the smallest thickness.

As explained hereinbefore, when the front working mechanism is in operation, either an axial compressive force (in excavating operations) or an axially stretching force (in craning operations) acts on the lower boom 80. Whichever direction the acting force is in, a lateral bending force acts on the lower boom 80 along with the axial force. The composite force of the acting axial force and bending force occurs in the maximum degree in the proximity of the cross-link 82, namely, in the right side plate 81*c*, while it barely occurs in the left side plate 81*d*. Taking these into consideration, a thicker plate is used for the right side plate 81*c* of the lower boom 80 to ensure higher strength, while, from the standpoint of weight reductions and material cost or economical reasons, a thinner plate is used for the left side plate 81*d* which is not required to meet any severe criteria in strength.

In this manner, plates of different dimensions, particularly of different thicknesses, are used for the four plates 81*a* to 81*d* of the lower boom 80 depending upon the loads which will be imposed on the respective plates, for the purpose of improving the strength against lateral bending forces which occur as a result of the singular cross-link arrangement. Nevertheless, this arrangement does not lead to any substantial increases in weight of the lower boom 80 as a whole because the respective plates 81*a* to 81*d* are limited to thicknesses for necessary strengths.

Regarding the plate thickness, although the respective plates of the lower boom have been shown as having a uniform thickness in the transverse direction, they may be arranged as shown in FIG. 8 if desired. In this case, the right and left side plates 83*c* and 83*d* consist of thick and thin platea each with a uniform thickness in the transverse direction, while the bottom and top plates 83*a* and 83*b* consists of plates each with a varying thickness in the transverse direction, namely, a thickness which is greatest on the side of the right side plate 83*c* where greater lateral bending loads are imposed and reduced continuously or stepwise toward the left side plate 83*d*.

POSSIBILITIES OF INDUSTRIAL UTILIZATION

By arranging a single cross-link to lie at one side of a boom as described above, it becomes possible to preclude the troubles of the boom hindering machine controlling operations by an operator who is seated on the driver's seat. In addition, despite the singular cross-link arrangement, by the location of a boom operating cylinder to a position which is shifted aside by a predetermined distance in a direction away from the cross-link, it becomes possible to prevent or suppress the lateral bending stresses, which would otherwise be imposed on the lower boom when driving the boom, thus permitting to move the boom smoothly and to prevent deformations of the lower boom as would result from repeated imposition of lateral bending stresses.

What is claimed is:

1. An excavation machine which comprises:

a base carrier, and an upper rotary body mounted on said base carrier and having a driver's seat and a front working mechanism in positions in proximity with each other, said front working mechanism including a boom for lifting working equipment up and down, an arm pivotally operatively connected to a fore end of said boom, and a bucket pivotally operatively supported on a fore end of said arm, said boom of said front working mechanism including a lower boom pivotally supported on a boom support bracket provided on said upper rotary body at a position alongside said driver's seat and an upper boom pivotally connected to a fore end of said lower boom, and a boom operating hydraulic cylinder connected between said lower boom and said boom support bracket; and an asymmetrical single cross-link boom assembly comprising a single cross-link connected between said support bracket and said upper boom along a lateral side of said boom away from said driver's seat, said boom operating cylinder being located at a position shifted aside from an axial centerline of said lower boom by a predetermined distance in a direction away from said cross-link to thereby offset a lateral bending load imposed on said boom by said single cross-link.

2. An excavation machine which comprises:

a base carrier, and an upper rotary body mounted on said base carrier and having a driver's seat and a front working mechanism in positions in proximity with each other, said front working mechanism including a boom for lifting working equipment up and down, an arm pivotally operatively connected to a fore end of said boom, and a bucket pivotally operatively supported on a fore end of said arm, said boom of said front working mechanism including a lower boom pivotally supported on a boom support bracket provided on said upper rotary body at a position alongside said driver's seat and an upper boom pivotally connected to a fore end of said lower boom, and a boom operating hydraulic cylinder connected between said lower boom and said boom support bracket; and an asymmetrical single cross-link boom assembly comprising a single cross-link connected between said boom support bracket and said upper boom along a lateral side of said boom away from said driver's seat, said lower boom having an axial centerline thereof located at a position shifted aside from an axial center line of a boom foot portion by a predetermined distance in the direction of said cross-link to thereby offset a lateral bending load imposed on said boom by said single cross-link.

3. An excavation machine which comprises:

a base carrier, and an upper rotary body being mounted on said base carrier and having a driver's seat and a front working mechanism in positions in the proximity with each other, said front working mechanism including a boom for lifting working equipment up and down, an arm pivotally operatively connected to a fore end of said boom, and a bucket pivotally operatively supported on a fore end of said arm, said boom of said front working mechanism including a lower boom pivotally supported on a bracket of a horizontally rotatable swing post provided on said upper rotary body at a position alongside said driver's seat and an upper boom pivotally connected to a fore end of said lower boom, and a boom operating hydraulic cylinder connected between said lower boom and said swing post; and a single cross-link boom assembly comprising a single cross-link connected between said boom support bracket of said swing post and said boom along a lateral side of said boom away from said driver's seat, said bucket having an axial centerline thereof located at a position shifted aside from a center axis of a boom foot portion in a direction away from said driver's seat to thereby offset a lateral bending load imposed on said boom by said single cross-link.

4. An excavation machine as defined in claim 2, wherein an axial centerline of said boom is located at a position shifted aside from a center position of the boom foot portion of said lower boom in a direction away from said driver's seat.

5. An excavation machine as defined in claim 1, wherein an axial centerline of said upper boom is located in parallel relation with an axial center portion of said lower boom extending from a boom foot portion to a pivotal connection with said upper boom, and at a position shifted aside from said center axis of said lower boom by a predetermined distance in a direction away from said driver's seat.

6. An excavation machine which comprises:

a base carrier, and an upper rotary body mounted on said base carrier and having a driver's seat and a front working mechanism in positions in proximity with each other, said front working mechanism including a boom for lifting working equipment up and down, an arm pivotally operatively connected to a fore end of said boom, and a bucket pivotally operatively supported on a fore end of said arm, said boom of said front working mechanism including a lower boom pivotally supported on a boom support bracket provided on said upper rotary body at a position alongside said driver's seat and an upper boom pivotally connected to a fore end of said lower boom, and a boom operating hydraulic cylinder connected between said lower boom and said boom support bracket;

an asymmetrical single cross-link boom assembly comprising a single cross-link connected between said support bracket and said upper boom along a lateral side of said boom away from said driver's seat; said lower boom having a box structure substantially of a square shape in section, and said box structure being formed by securely joining together four plates of different thicknesses and having a side plate on a side facing said cross-link which is thicker than a side plate located at the opposite side of said box structure to thereby reinforce against a lateral bending load imposed on said boom by said single cross-link.

7. An excavation machine as defined in claim 6, wherein said box structure of said lower boom is provided with a thickest plate on a bottom side, a secondly thickest plate on a lateral side facing said cross-link, a plate of less thickness on a lateral side away from said cross-link, and a plate of smallest thickness on a top side thereof.

* * * * *